US009727027B2

(12) United States Patent
Feron Longmoor et al.

(10) Patent No.: US 9,727,027 B2
(45) Date of Patent: Aug. 8, 2017

(54) PORTABLE OBJECT FOR CONTROL OF AN ADDITIONAL ACTIVITY

(71) Applicant: ETA SA MANUFACTURE HORLOGERE SUISSE, Grenchen (CH)

(72) Inventors: Steve Feron Longmoor, La Chaux-de-Fonds (CH); Dominique Dubugnon, Etoy (CH); Pierre Deleglise, Yverdon (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 15/109,026

(22) PCT Filed: Dec. 11, 2014

(86) PCT No.: PCT/EP2014/077408

§ 371 (c)(1),
(2) Date: Jun. 29, 2016

(87) PCT Pub. No.: WO2015/104129

PCT Pub. Date: Jul. 16, 2015

(65) Prior Publication Data

US 2016/0327914 A1 Nov. 10, 2016

(30) Foreign Application Priority Data

Jan. 10, 2014 (EP) ..... 14150840

(51) Int. Cl.
*G04F 1/00* (2006.01)
*G04F 8/00* (2006.01)
(Continued)

(52) U.S. Cl.
CPC ..... *G04F 10/00* (2013.01); *G04F 1/005* (2013.01); *G04F 8/00* (2013.01); *G04F 8/006* (2013.01); *G07C 1/22* (2013.01)

(58) Field of Classification Search
CPC ... G04F 1/00; G04F 1/005; G04F 8/00; G04F 8/006; G04F 10/00; G07C 1/22
See application file for complete search history.

(56) References Cited

U.S. PATENT DOCUMENTS 4,797,864 A * 1/1989 Stano ..... G07C 1/22 368/107
6,144,619 A * 11/2000 Reisman ..... G04F 1/005 368/10
(Continued)

FOREIGN PATENT DOCUMENTS

EP 0 130 150 A1 1/1985
EP 2 503 416 A1 9/2012
(Continued)

OTHER PUBLICATIONS

International Search Report issued on Aug. 5, 2015 for PCT/EP2014/077408 filed on Dec. 11, 2014.

*Primary Examiner* — Vit W Miska
(74) *Attorney, Agent, or Firm* — Oblon, McClelland, Maier & Neustadt, L.L.P.

(57) ABSTRACT

A watch including an electronic movement driving display for an analog display on a dial of at least one additional function in addition to a normal current time display, the at least one function being controlled by a controller and including at least one phase using an operating mode in which a duration of the phase is measured.

16 Claims, 8 Drawing Sheets

(51) Int. Cl.
*G07C 1/22* (2006.01)
*G04F 10/00* (2006.01)

(56) References Cited

U.S. PATENT DOCUMENTS

| | | | | |
|---|---|---|---|---|
| 6,167,000 | A * | 12/2000 | Chow | G04G 9/0082 307/141 |
| 6,904,001 | B1 * | 6/2005 | Rast | A44B 11/008 368/107 |
| 7,187,303 | B2 * | 3/2007 | Boyns | G01C 23/00 340/309.16 |
| 7,345,958 | B1 | 3/2008 | Kneafsey | |
| 2003/0058744 | A1 | 3/2003 | Calace | |
| 2004/0008589 | A1 * | 1/2004 | McMillan | G07C 1/00 368/223 |
| 2014/0064042 | A1 | 3/2014 | Ruestenberg et al. | |

FOREIGN PATENT DOCUMENTS

| | | |
|---|---|---|
| FR | 2 641 396 A3 | 7/1990 |
| GB | 2 435 113 A | 8/2007 |

* cited by examiner

PORTABLE OBJECT FOR CONTROL OF AN ADDITIONAL ACTIVITY

The present invention concerns a watch including an electronic movement driving display means for the analogue display on a dial of at least one additional function in addition to the normal current time display, said at least one function including at least two phases of operation, in each of which the duration of said phase is calculated.

BACKGROUND OF THE INVENTION

There are known in the prior art timepieces, such as watches, provided with an application specific function, such as for a sport.

A known example of application is a football related application. This football specific function is thus used by referees for measuring the time of different phases of play, such as the halves of the match or periods of extra time.

However, in the example of football, it is only time that is recorded. In fact, there are sports in which occurrences, such as penalty points due to athlete errors or time-related faults, are recorded as well as the measured time.

A known application is to equestrian sport and more specifically show jumping. Show jumping takes place in an arena in which obstacles are placed. The poles that form the obstacles are movable and fall down when they are touched. For the horse and the rider, the object is to jump the various obstacles in a particular order without knocking them down, refusing or avoiding them, and the time taken to jump the various obstacles is measured.

However, there are various point scoring tables or operating modes for classifying the participants.

A first scoring table or operating mode called Table A consists in predefining a set time for jumping the various obstacles. When the rider exceeds this time, penalty points are incurred according to the extra time taken. Penalty points are also added when an obstacle is touched and one of the poles is knocked down. Table A also includes a time limit beyond which the rider is eliminated, such time being equal to twice the set time.

A second scoring system or operating mode called Table C consists in predefining a time limit for jumping the various obstacles. When the rider exceeds this time, he is eliminated. Penalty points are also added when an obstacle is touched and one of the poles is knocked down, these points are converted to additional time which is added to the rider's time.

Thus, a device capable of effectively managing a show jumping competition does not currently exist and known devices can only measure the time taken to jump the various obstacles, and cannot take account of penalties.

SUMMARY OF THE INVENTION

The invention concerns a portable object which overcomes the aforementioned drawbacks of the prior art by proposing a portable object able to perform time measurements, while manually and/or automatically taking account of random occurrences such as penalties.

To this end, the invention concerns a watch comprising an electronic module driving display means for the display of at least one additional function in addition to the normal current time display, said at least one function being controlled by control means and comprising at least one phase using at least one operating mode in which the duration of said phase is measured and compared to a reference value, characterized in that the electronic module also allows at least the manual counting and the display of one type of random occurrences, occurring during said phase, for said at least one operating mode.

In a first advantageous embodiment, said operating mode is a first operating mode in which said measured phase duration is compared to a first reference value and the random occurrences comprise a first type of occurrence, automatically taken into account when said measured phase duration exceeds the first reference value, and a second type of occurrence manually taken into account by the user by means of the control means.

In a second advantageous embodiment, said operating mode is a second operating mode in which said measured phase duration is compared to a second reference value and the random occurrences comprise a third type of occurrence, automatically recorded when said measured phase duration exceeds the second reference value, and a fourth type of occurrence manually recorded by the user by means of the control means.

In a third advantageous embodiment, said additional function phase comprises at least a first operating mode and a second operating mode, the first or second operating mode being selected.

In a fourth advantageous embodiment, in the first operating mode, the first type of occurrence and the second type of occurrence cause a first counting means to be incremented.

In another advantageous embodiment, in the second operating mode, the third type of occurrence causes said phase to stop, and the fourth type of occurrence causes a first counting means to be incremented.

In another advantageous embodiment, the display means comprise a first counter for the display of at least one item of information relating to the management and recording of random occurrences and a central hand associated with a second counter for displaying at least the measurement of said phase duration.

The present invention also concerns a function control method for a portable object, said portable object comprising an electronic module driving display means for the display of at least said additional function in addition to the normal current time display, said at least one function being controlled by control means of the portable object and comprising at least one phase using at least one operating mode, characterized in that the additional function is capable of changing from a rest phase, in which time is not measured, to an operating phase, in which time is measured, said operating phase comprising the following steps:

- D: counting down until the control means are activated by the user or until the countdown has finished;
- E: measuring time and managing and taking account of random occurrences occurring during said phase for said operating mode;
- F: displaying the results of step E.

In a first advantageous embodiment, said operating mode is a first operating mode, in step E in this first operating mode, said measured phase duration is compared to a first reference value and the random occurrences comprise a first type of occurrence, automatically recorded when said measured phase duration exceeds the first reference value, and a second type of occurrence, recorded manually by the user by means of the control means.

In a second advantageous embodiment, said operating mode is a second operating mode, in step E in this second operating mode, said measured phase duration is compared to a second reference value and the random occurrences comprise a third type of occurrence, automatically recorded when said measured phase duration exceeds the second reference value, and a fourth type of occurrence, recorded manually by the user by means of the control means.

In a third advantageous embodiment, the first occurrence and the second occurrence are counted as points.

In a fourth advantageous embodiment, the fourth occurrence is counted as extra time.

In a fifth advantageous embodiment, said additional function phase comprises at least a first operating mode and a second operating mode, the first or second operating mode being selected.

In another advantageous embodiment, the selection of the first or second operating modes for the operating phase is made in a setting phase.

In another advantageous embodiment, the setting phase includes the following steps:

A: selecting, via the control means, the first operating mode or the second operating mode and then validating the selection;

B: setting an item of time information according to the first operating mode or the second operating mode;

C: setting an item of random occurrence information according to the first operating mode or the second operating mode.

In another advantageous embodiment, for the first operating mode, said time information set during step B is said first reference value, and said random occurrence information set during step C relates to the second type of occurrence.

In another advantageous embodiment, for the second operating mode, said time information set during step B is said second reference value, and said random occurrence information set during step C relates to the fourth type of occurrence.

In another advantageous embodiment, the setting phase is automatic, as the electronic module comprises a communication circuit for directly receiving the setting data.

In another advantageous embodiment, the additional function relates to horse show jumping.

In another advantageous embodiment, said first type of occurrence, automatically recorded when said measured phase duration exceeds the first reference value, is a settable duration and entails incrementing a penalty counter.

In another advantageous embodiment, said second type of occurrence, recorded manually, is a rider fault and entails incrementing a penalty counter.

In another advantageous embodiment, said third type of occurrence, automatically recorded when said measured phase duration exceeds the second reference value, is the elimination of the rider.

In another advantageous embodiment, said second type of occurrence, recorded manually, is a rider fault and entails incrementing the measured duration.

BRIEF DESCRIPTION OF THE DRAWINGS

The objects, advantages and features of the portable object according to the present invention will appear more clearly in the following detailed description of at least one embodiment of the invention given by way of non-limiting example and illustrated by the annexed drawings, in which.

DETAILED DESCRIPTION

Figure 1:
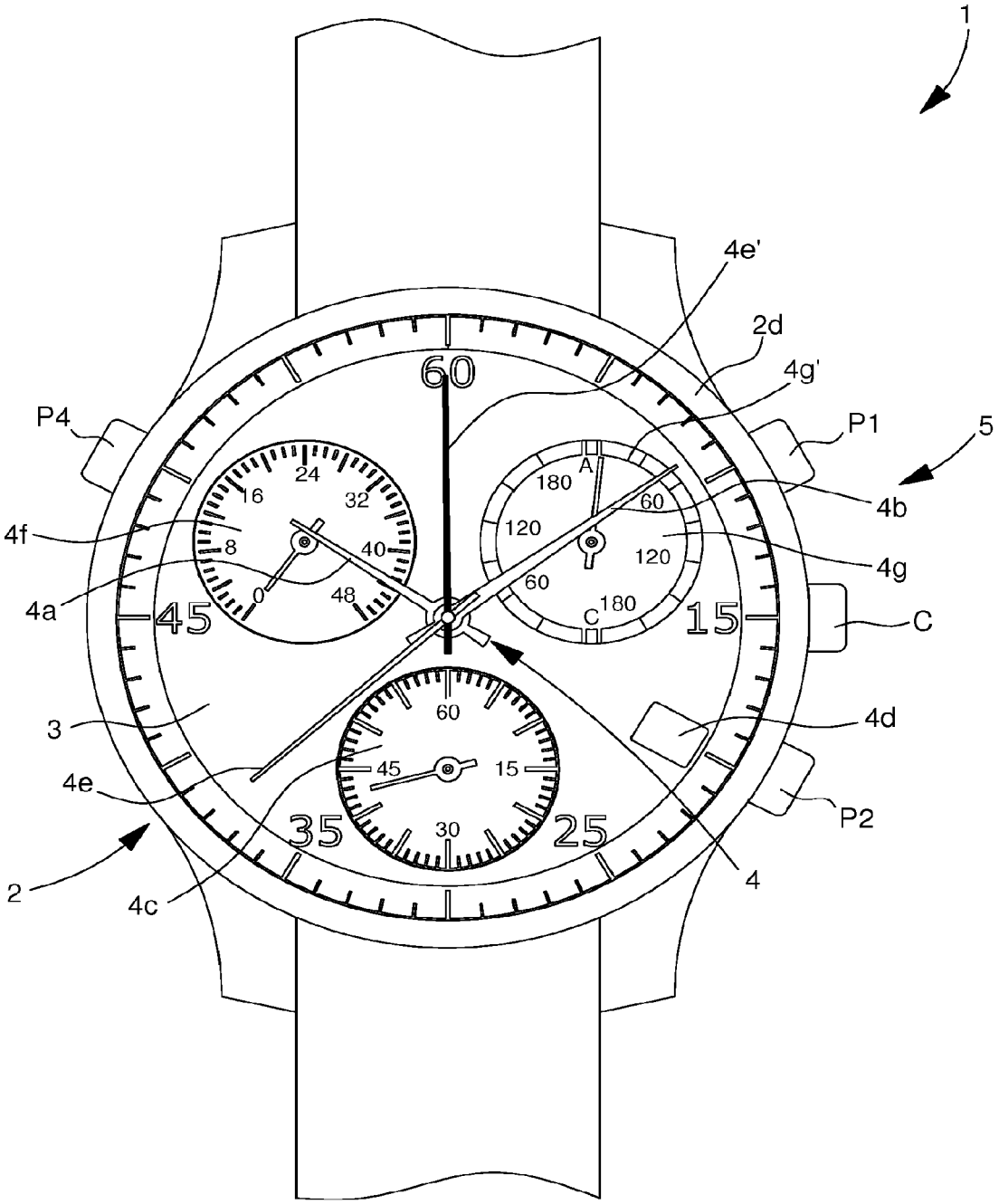
FIG. 1 is a schematic view of the portable object according to the present invention.

FIG. 1 represents a portable object according to the invention. Here, this portable object takes the form of a timepiece, but it may take the form of a mobile telephone or touch tablet. FIG. 1 represents the dial of the timepiece or watch 1 according to the present invention. This timepiece 1 comprises a case 2 including a case middle 2*a* closed by a back cover 2*c* and a crystal 2*b*. There may also be a bezel 2*d* surrounding crystal 2*b*, which may be a rotating or fixed bezel. Case 2 is intended to receive an electronic timepiece movement 6. The case is also intended to receive a dial 3. The timepiece movement comprises display means 4 for indicating information on dial 3. Display means 4 may permit an analogue display, i.e. which gives the time indication by the relative movement of a pointer and a scale, or they may permit a digital display giving the time indication in digital form.

The electronic timepiece movement or electronic module 6 provides at least one item of time information in order to display the current time comprising the hour, the minutes, the seconds and the date. In a non-limiting example, display means 4 comprise a plurality of display members. These display members for the current time display take the form of a central hour hand 4*a*, a central minute hand 4*b*, a counter with a hand 4*c* at 6 o'clock and an aperture 4*d* for the date.

The display members could also take the form of discs or the form of electronic display members using LED or LCD technology. These display members make possible an analogue or digital display. For example, it is possible for the electronic display members to permit the virtual representation of a hand moving on a time scale.

The timepiece also includes control means 5 for controlling the various functions of said timepiece 1. These control means comprise control members comprising a crown C, surrounded on either side by a first push-button P1 located at 2 o'clock and a second push-button P2 located at 4 o'clock. Crown C can be pulled out to take 3 positions T1, T2 or T3.

Advantageously, the portable object is configured to permit control of an additional function. This additional function is related to a preferably sporting activity and allows the user to follow and control this activity. In the example of the present description, this activity is an equestrian activity and, more particularly, a show jumping activity. This additional function is able to have several operating modes.

To achieve this, the portable object display means 4 also comprise a central hand 4*e* for a time indication associated with a scale of 60 seconds, a first counter 4*f* located at 9 o'clock used for penalties, and a second counter 4*g* located at 3 o'clock used for a time indication and the indication of the scoring system or operating mode used. The second counter 4*g* comprises a hand and is divided into several sections 4*g*', the section number being equal to the possible number of scoring systems. In the case where there are two scoring systems: Table A and Table C, counter 4*g* comprises two sections 4*g*': a first section 4*g*' relating to Table A and a second section 4*g*' relating to Table C. Each section 4*g*' comprises a scale to which the hand of counter 4*g* points to indicate time information. Each section 4*g*' also carries the name of the Table with which it is associated. The scale of each section 4*g*' is divided into 30-second intervals. The total time displayable by each section 4*g*' is the maximum time for a show jumping competition, namely two hundred and ten seconds. Of course, the present invention is not limited simply to Table A and Table C and a higher number of scoring systems may be taken into account.

The portable object control means 5 further comprise a third push-button P4 at 10 o'clock used for operation of this additional function. The operations that will be described in the following description are merely illustrative and may be changed.

In a rest phase seen in FIG. 1, in which only the current time is displayed, central hand 4*e* is set to zero, the hand of first counter 4*f* is set to zero and the hand of second counter 4*g* is in a neutral position located between the different sections 4*g'*.

In a first phase, also called the preliminary phase or setting phase, the user is invited to set the various parameters. To enter this preliminary phase, a long press is made on push-button P4. Once this setting phase is entered, there are several successive steps.

Figure 2A:
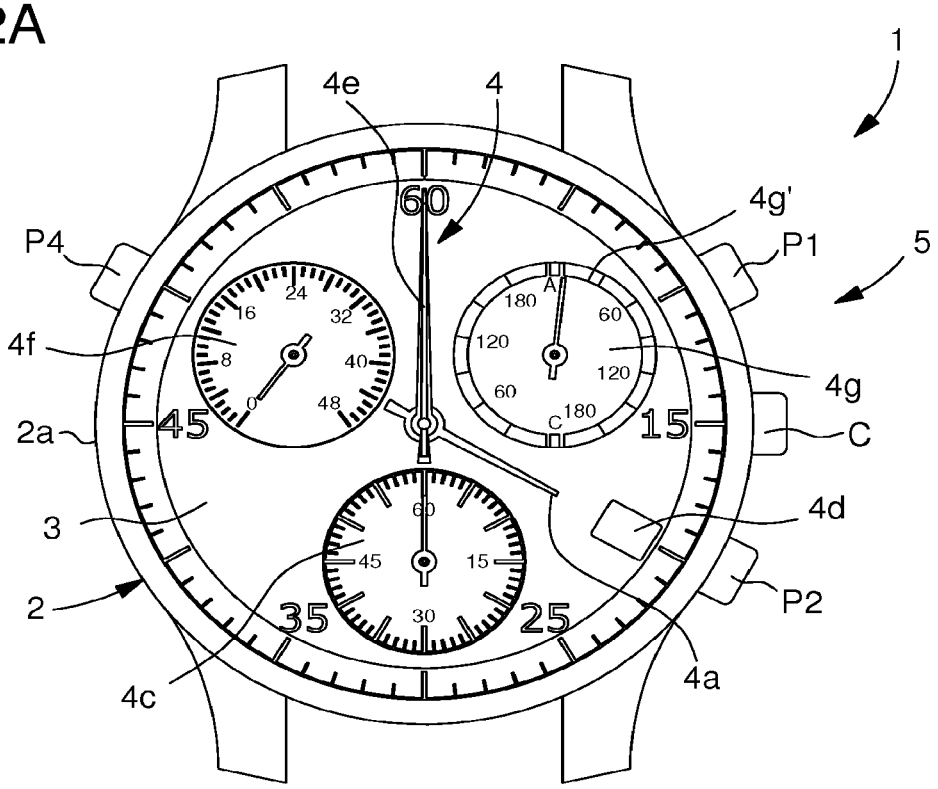
FIGS. 2A to 12 show schematic views of the various phases of the portable object during operation of the equestrian function according to the invention.
Figure 2B:
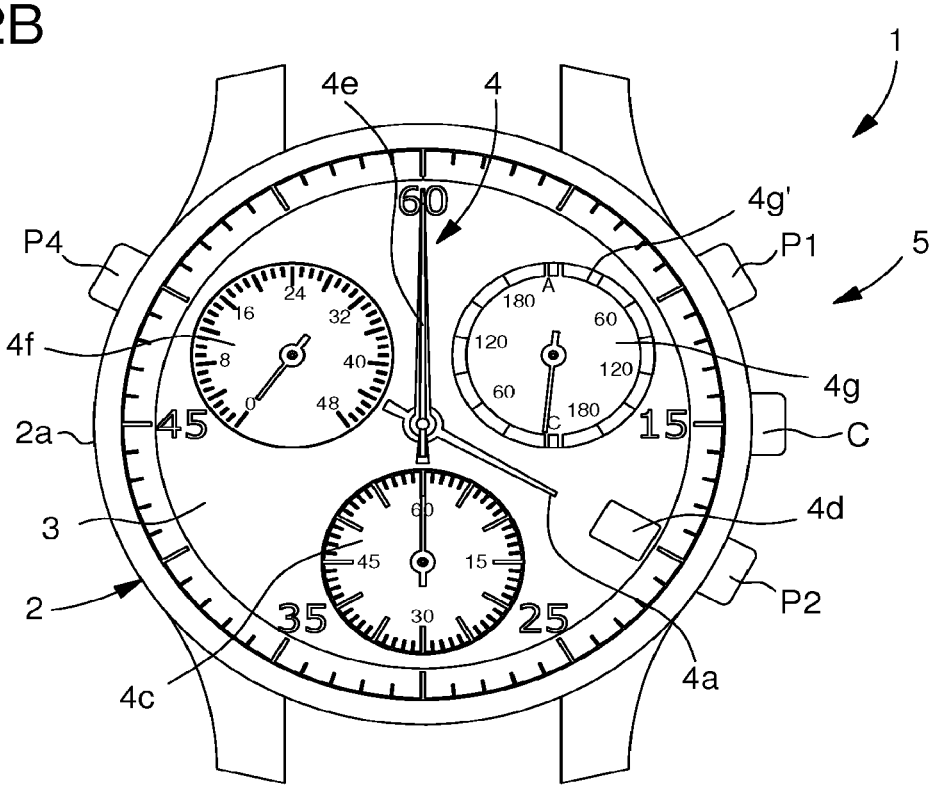

In a step A, the type of scoring system or operating mode is selected. To change from one scoring system to another, push-button P1 or P2 is pressed. When there is a change of scoring system, the hand of counter 4*g* moves to point to the letter A or C marked on the scale of the selected section 4*g'*. Push-button P4 is pressed to validate the scoring system selection. In FIG. 2A, it is seen that Table A is selected, whereas in FIG. 2B, Table C is selected.

In a variant of this step, called A', a press on push-button P1 selects Table C, whereas a press on push-button P2 selects Table A.

The press on push-button P4 to validate the selection also enables step B to be activated. In step B, the time settings for the course are effected.

Figure 3A:
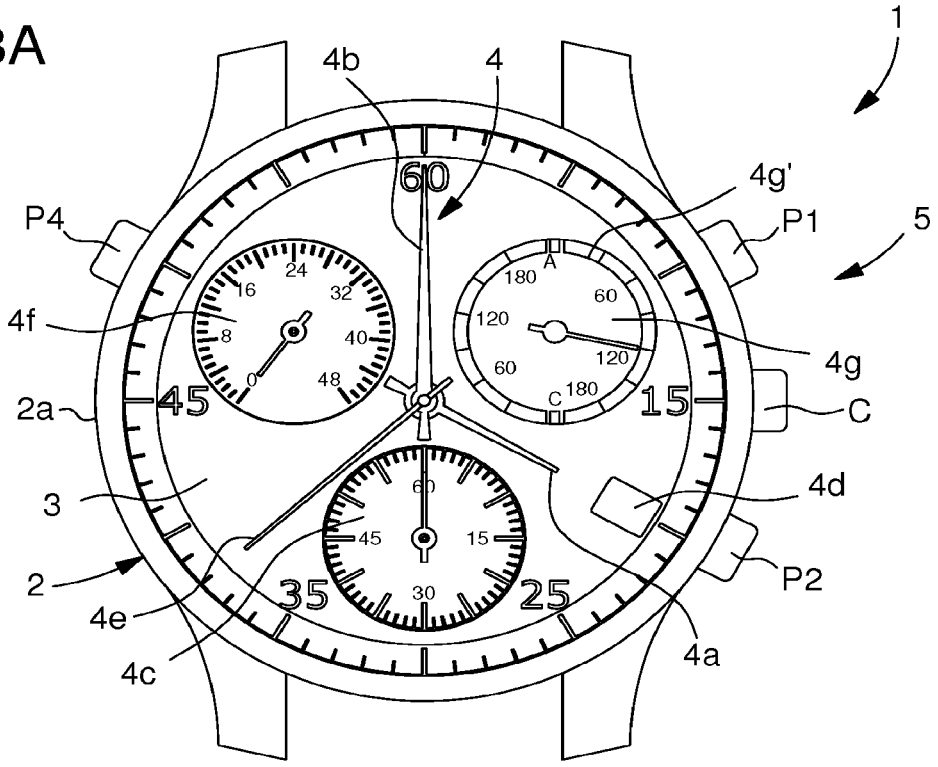

If Table A is selected, the user must define the set time for the competition. To do so, he uses push-buttons P1 and P2 to respectively increment or decrement the time, a long press making it possible to increment or decrement more rapidly. Display means 4 are arranged such that central hand 4*e* starts to rotate to indicate the seconds. For every sixty seconds of elapsed time, the hand of second counter 4*g* moves along the scale of the first section 4*g'*. In FIG. 3A, it is seen that a time of one hundred and fifty-eight seconds is indicated, i.e. 2 minutes and 38 seconds.

Figure 3B:
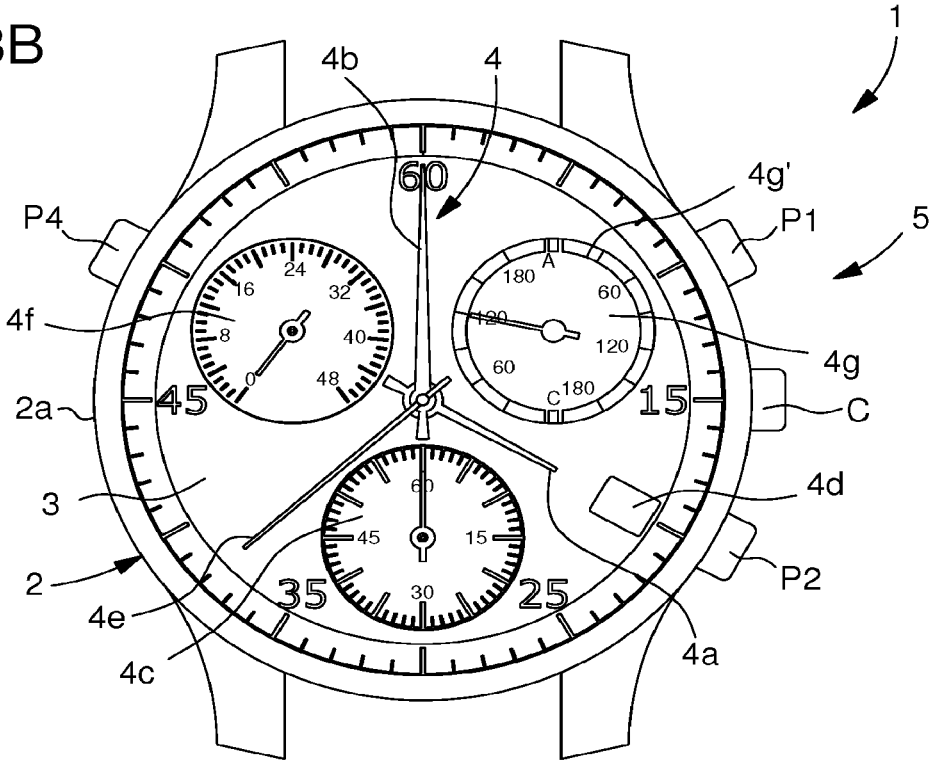

If Table C is selected, the user must define the time limit for the competition. To do so, he uses push buttons P1 and P2 to increment or decrement the time, a long press making it possible to increment or decrement more rapidly. Display means 4 are arranged such that central hand 4*e* starts to rotate to indicate the seconds. For every sixty seconds of elapsed time, the hand of second counter 4*g* moves along the scale, which is graduated in intervals of thirty seconds. In FIG. 3B, it is seen that a time of one hundred and fifty-eight seconds is indicated, i.e. 2 minutes and 38 seconds.

In a variant of this step called B', it is also possible to envisage pre-programmed time limits for Table C. Push-buttons P1 and P2 make it possible to change from one time to another. In such case, only the hand of second counter 4*g* moves. For example, pre-programmed time limits may be of two or three minutes.

Once the time is set for Table A or Table C, push-button P4 is pressed to validate the setting and to change to the next step.

In a step C, the penalty settings are made, these penalties are random occurrences managed by the electronic timepiece movement or electronic module 6. To achieve this, a query is made as to the type of scoring table and more specifically, a query is made as to whether Table A is selected.

If affirmative, the user is offered the possibility of choosing between the different possible types of penalties or random occurrences. In fact, in Table A, the penalty for knocking down an obstacle is four points and penalties for exceeding the set time depend on the time taken. One penalty point is incurred per duration of time over the set time. For example, one penalty point is incurred for every second or for every four seconds over the set time. This is the type of penalty that is set by the user, who utilises push-buttons P1 and P2 to change the configuration of 1 pt/sec or 1 pt/4 sec.

Figure 4A:
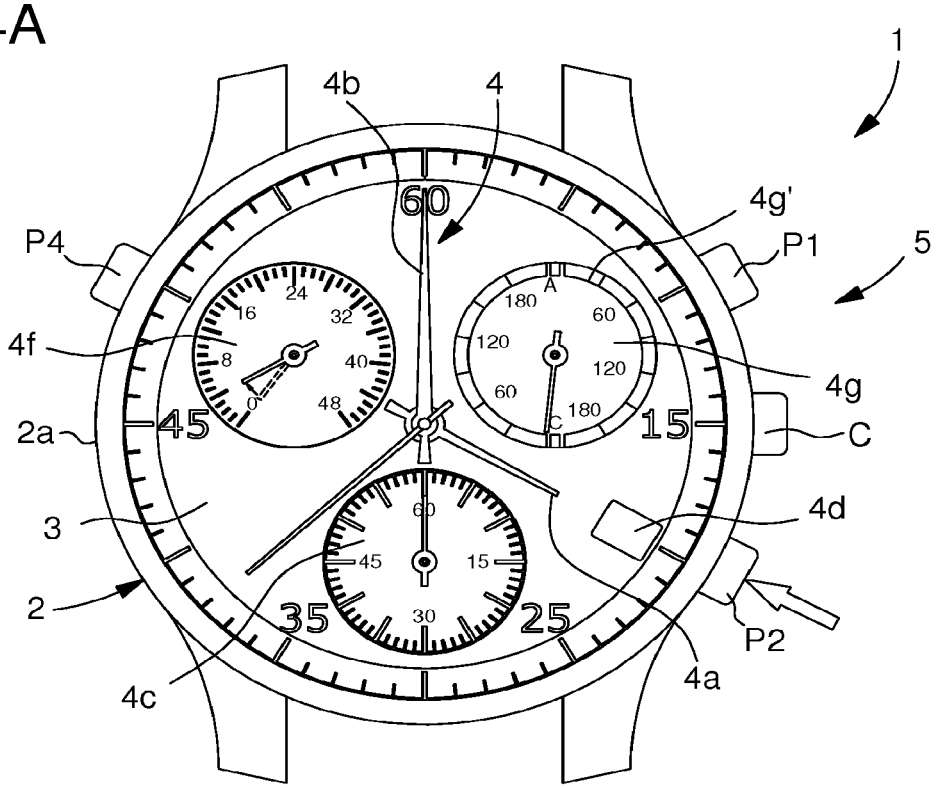

To indicate the time, the hand of first counter 4*f* moves on the scale which corresponds to 1 or 4, position 1 meaning 1 pt/sec whereas position 4 means 1 pt/4 sec. In FIG. 4A, the hand of first counter 4*f* moves and goes to position 4 to indicate 1 pt/4 sec.

If the response to the query is negative, i.e. Table C is selected, the user is offered the possibility of setting the penalty value. In fact, under Table C, penalties are only incurred for knocking down an obstacle and are converted to additional time added to the rider's time. This additional time is configurable and may have a value of two or three or four seconds. Push-buttons P1 and P2 are then used respectively to increment or decrement the penalty time.

Figure 4B:
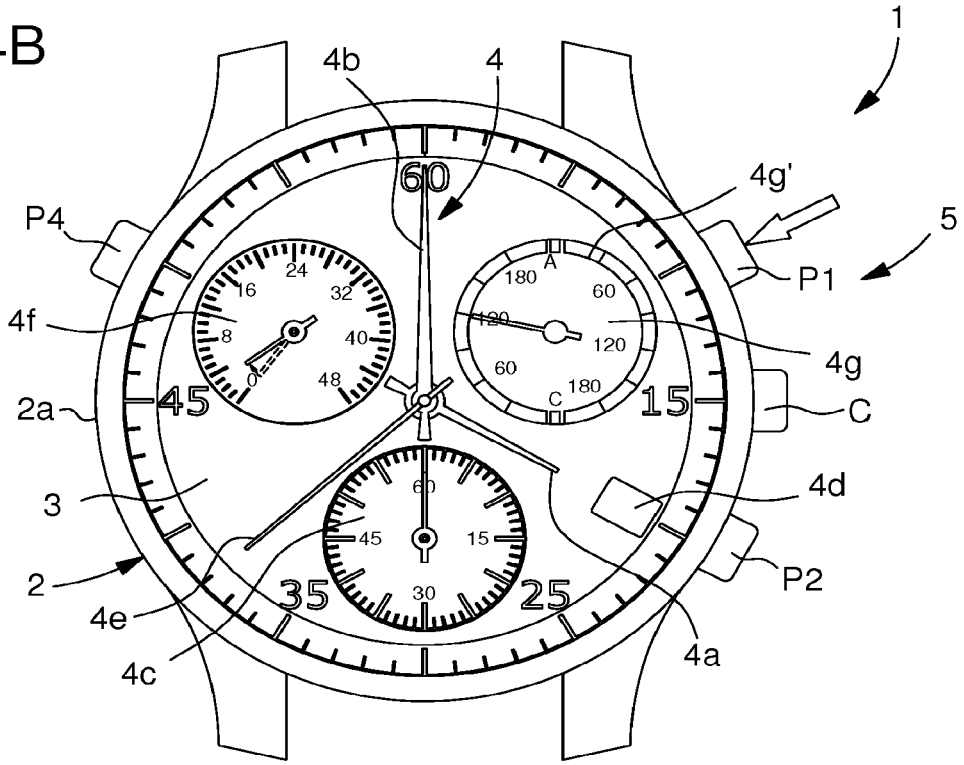

To indicate the time, the hand of first counter 4*f* moves on its scale which corresponds to two, three or four, respectively meaning an additional 2 seconds, 3 seconds or 4 seconds per penalty. In FIG. 4B, the hand of first counter 4*f* moves and goes to position 3 to indicate an additional 3 seconds per penalty.

Once the penalties have been set for Table A or Table C, push-button P4 is pressed to validate the setting and to return to the setting of the scoring table. A long press is made on push-button P4 to exit the setting phase and to enter the rest phase.

Of course, this first phase is optional. Indeed, electronic timepiece movement 6 could include a wireless communication circuit of the Wi-Fi or Bluetooth or RFID type to directly receive information about the competition and to ensure mistakes are not made.

Figure 5:
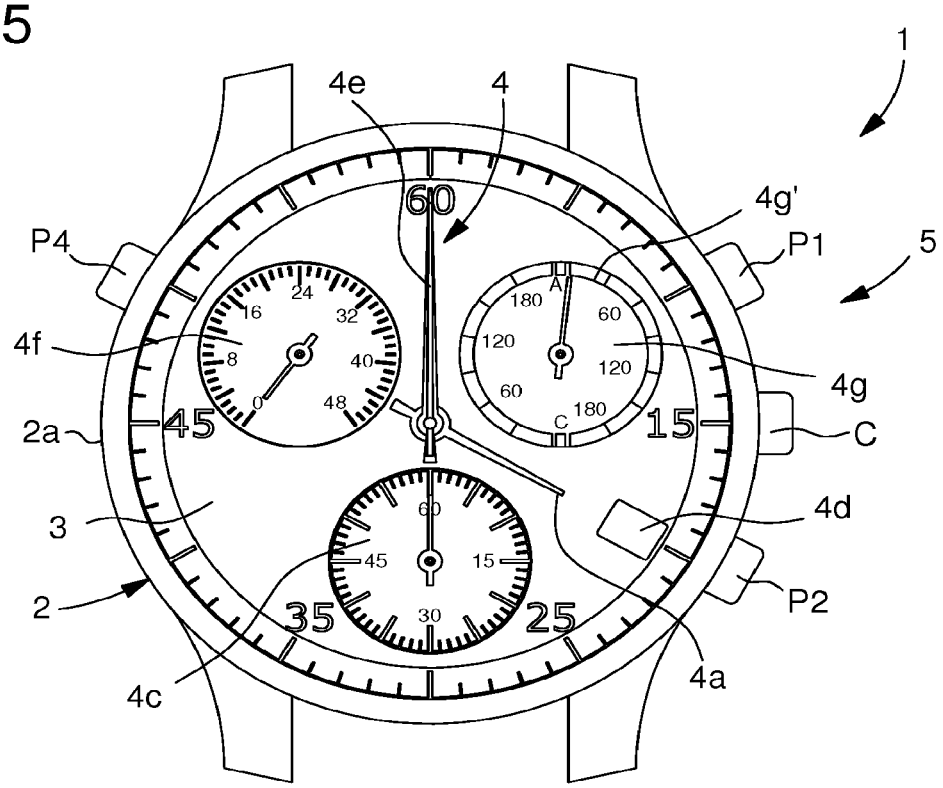

The long press is made on push-button P4 to exit the rest phase and enter straight into a second phase also called the competition phase or operating phase. In this second phase, the user can manage a rider's competition by timing him and tracking and recording his penalties. In this second phase, central hand 4*e* is in the zero position, the hand of first counter 4*f* is in the zero position, whereas the hand of second counter 4*g* points to the zero position in the section 4*g'* relating to the selected scoring system as seen in FIG. 5.

A press on push-button P4 causes electronic timepiece module 6 to enter a countdown step D. This countdown is used in a preparatory phase in which the rider and his horse are preparing to jump the course. A second press on push-button P4 starts the countdown, which is 45 seconds. A press on push-button P1 can stop and resume the countdown, whereas a press on push-button P1 returns the countdown to zero. When the countdown reaches zero or the user presses on push-button P4, the countdown ends and step E starts.

Figure 6:
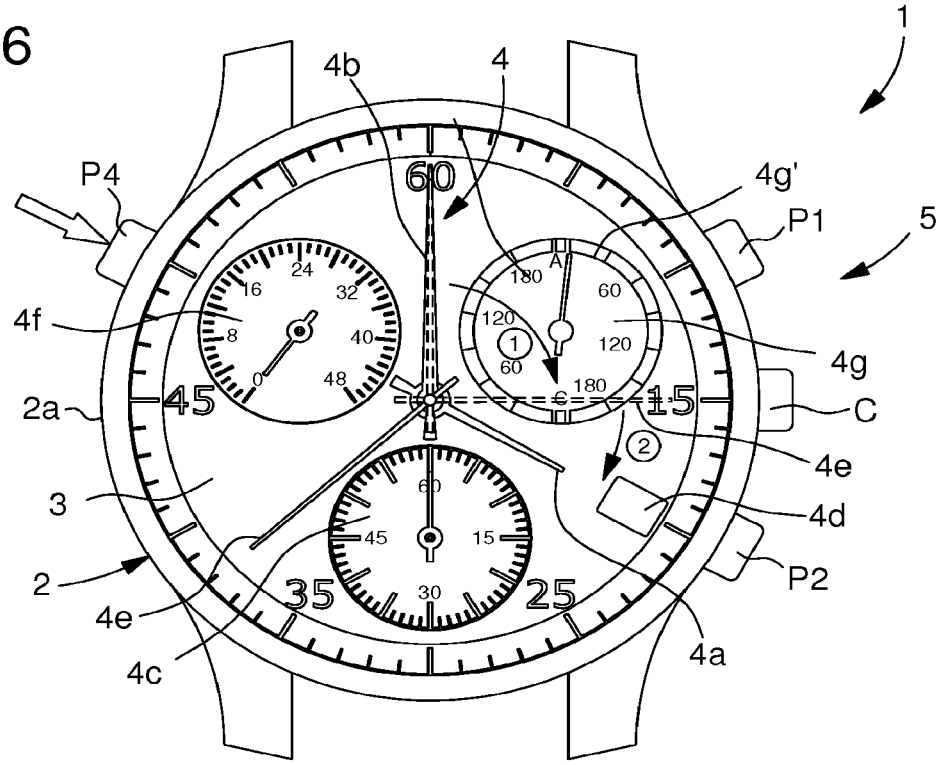

In a variant of this step called D', the countdown is configured such that, following the press on push-button P4 to start said countdown, the hand is instantaneously moved in a rotation (1) from its rest position 0 to position 15 on said scale and then starts a countdown as seen in FIG. 6. In FIG. 6, hand 4*e* is located at position 38, i.e. twenty-three seconds have elapsed.

Step E consists in managing the jumping of the course by the rider. The end of the countdown automatically causes the chronometer to start. Central hand 4*e* is then instantaneously placed in position 0 and then starts to rotate at a rate of one step per second.

Figure 7:
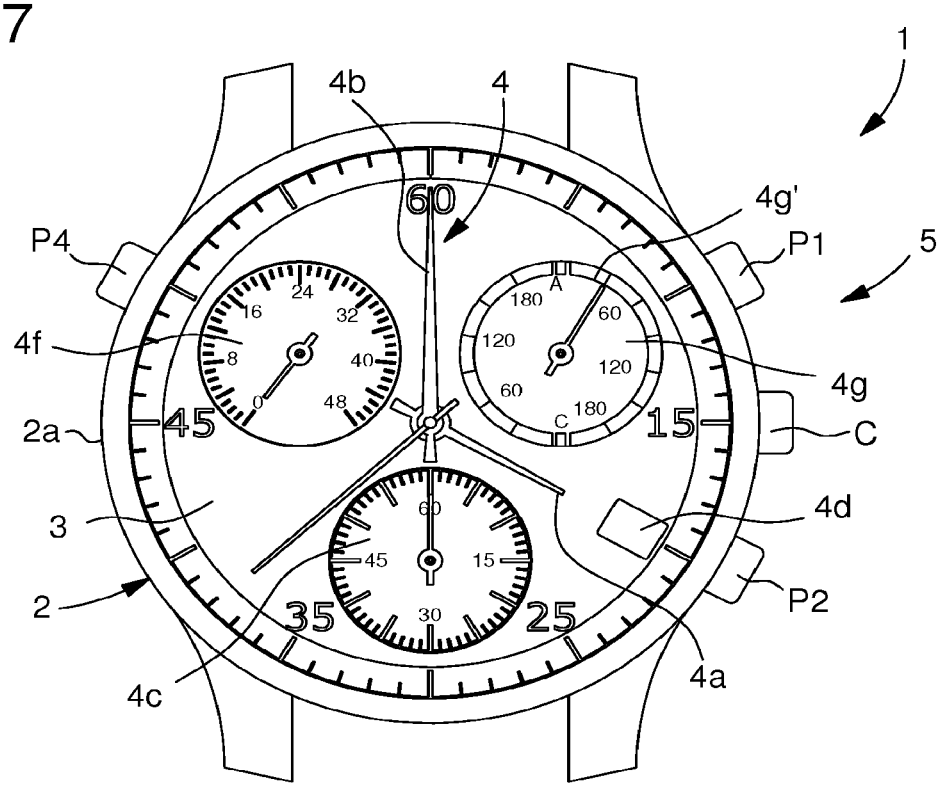

In the case of Table A, when central hand 4*e* makes one revolution, the hand of second counter 4*g* moves and goes to the 60-second scale graduation. In FIG. 7, it is seen that the hand of second counter 4*g* is placed on the 60-second scale graduation and that central hand 4*e* is placed in position 38 indicating that the time elapsed is 98 seconds, i.e. 1 min 38 sec.

Figure 8:
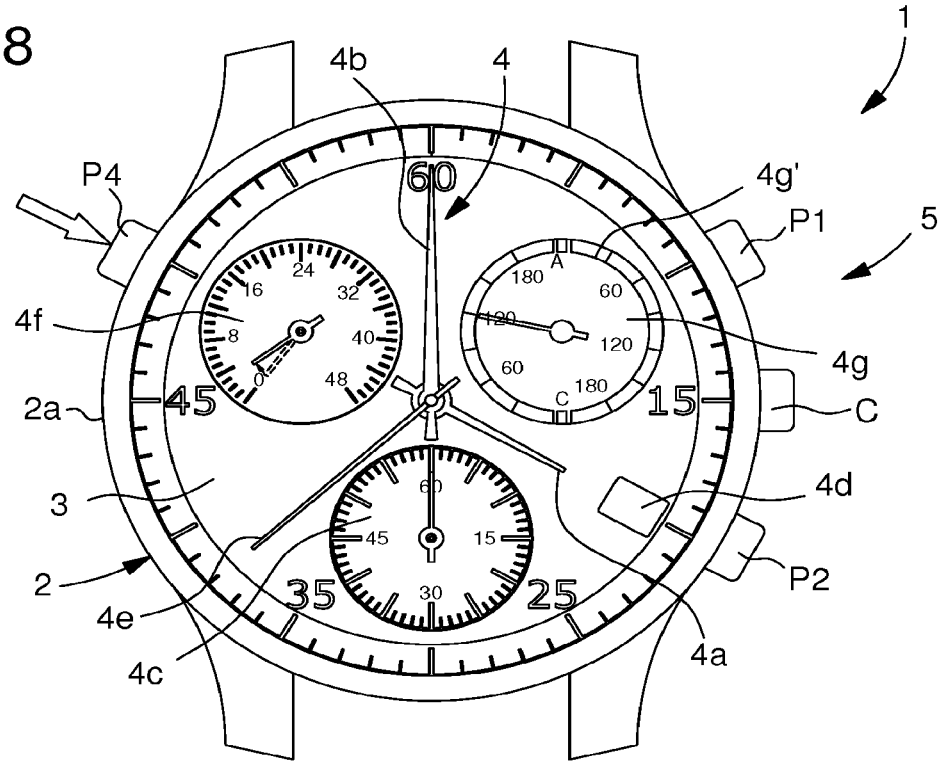

When a fault of the rider causes an obstacle to fall, a penalty is recorded by a first counting means. This penalty is added by one press on push-button P2. The penalties counted by the first counting means are displayed by first counter 4*f*. The hand of this first counter 4*f* moves on the scale at a rate of 4 points per penalty, as seen in FIG. 8.

Figure 9:
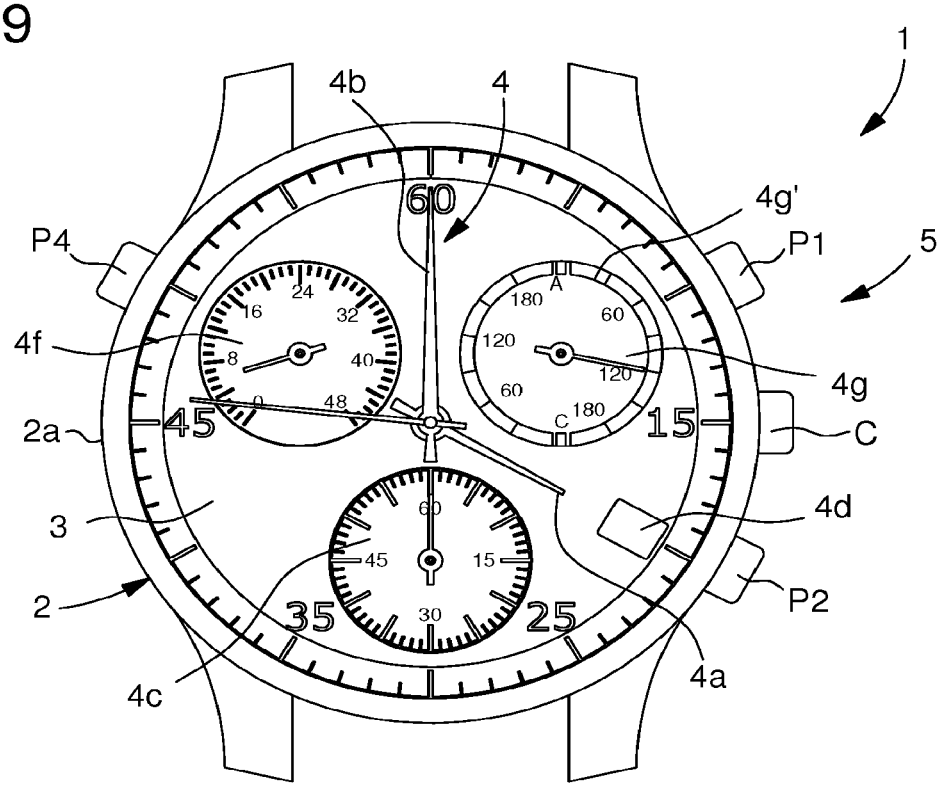

When the set time is exceeded, central hand 4*e* continues to move but penalty points are added. According to the setting made in step C, one penalty point is added on first counter 4*f* for 4 seconds over the predefined time of 2 minutes 38 seconds. In FIG. 9, it is seen that the elapsed time is 2 minutes 46 seconds, i.e. 8 seconds over the predefined time. With a scale of 1 point for every four seconds over the predefined time, there are therefore two penalty points added. A time limit could also be provided beyond which the rider is eliminated, this time being equal to twice the set time.

Once the rider has crossed the finish line, a press on push-button P4 stops the time measuring phase.

In the case of Table C, when central hand 4*e* makes one revolution, the hand of second counter 4*g* moves and goes to the 60-second scale graduation of section 4*g*' relating to Table C.

Figure 10:
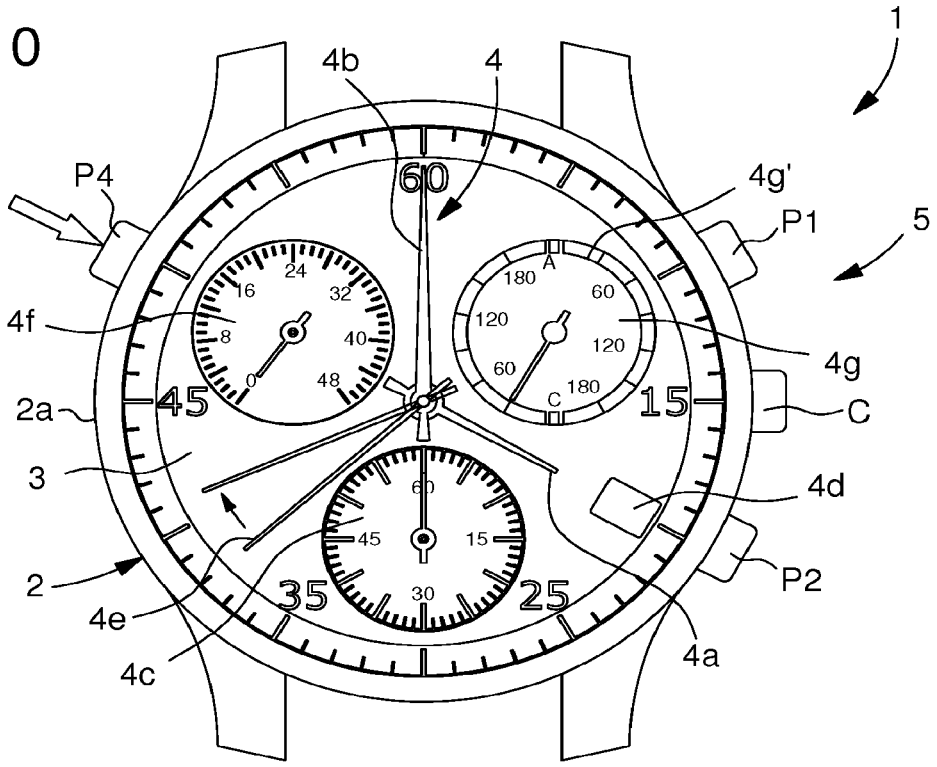

When a fault of the rider causes an obstacle to fall, a penalty is counted by the first counting means. This penalty is added by one press on push-button P2. This penalty counted by the first counting means is displayed by an advance of central hand 4*e*. Indeed, under Table C, each fault of the rider results in additional time. This additional time is added to the time measured in said step E. Central hand 4*e* advances instantaneously and automatically by two, three or four seconds. FIG. 10 represents the case where an additional time of 3 seconds per penalty was validated in step C. In FIG. 10, the penalty is incurred when the measured time is thirty-eight seconds, in this case, one press on P4 results in three additional seconds, with central hand 4*e* moving instantaneously to point to position 41.

When the time limit is exceeded, central hand 4*e* stops, meaning that the rider is eliminated. If the time limit is not reached, once the rider has crossed the finish line, a press on push-button P4 stops the time measuring phase.

This press on push-button P4 makes it possible to stop the time measurement and change to a step F.

Step F is a step in which the information about the rider's round is displayed to the user.

In the case of Table A, the information displayed is time information from central hand 4*e*, from the hand of second counter 4*g* and penalty information from first counter 4*f*.

In the case of Table C, the user is given the choice of the type of information to be displayed. In fact, the user is given the possibility of displaying the total time, i.e. including penalties due to faults, or of separating the time taken by the rider to complete the round and the penalties.

To achieve this, electronic timepiece module 6 is able to store the number of penalties via the first counting means. Since the time value of a penalty is set by the user, electronic module 6 is capable of subtracting the added penalty time from the total time. The round time is then displayed by central hand 4*e*, while the number of penalties is displayed on first counter 4*f*. This ability to separate the round time and the number of penalties allows the rider to know his net round time, i.e. without the penalties. In an example seen in FIGS. 11 and 12, the total time of the user is 1 minute 38 seconds, with 5 penalties of three seconds each having been added.

Figure 11:
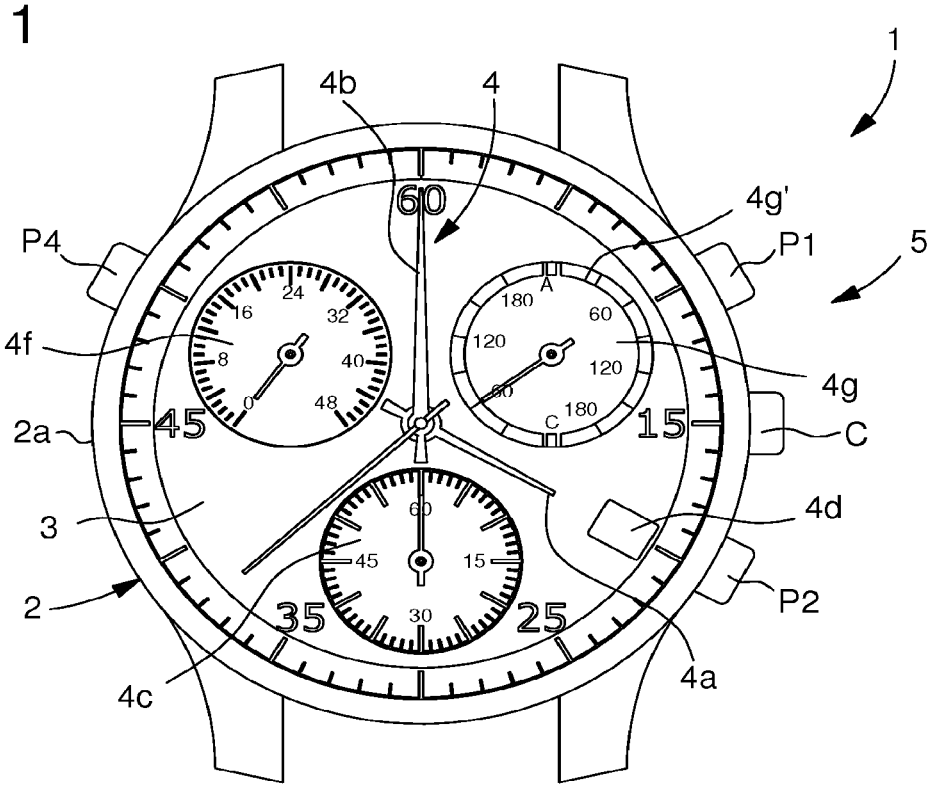

In the case, seen in FIG. 11, where only the time is displayed, the hand of second counter 4*g* thus indicates the 60-second position of section 4*g*' relating to Table C, with central hand 4*e* indicating position 38. The hand of first counter 4*f* is placed at zero.

Figure 12:
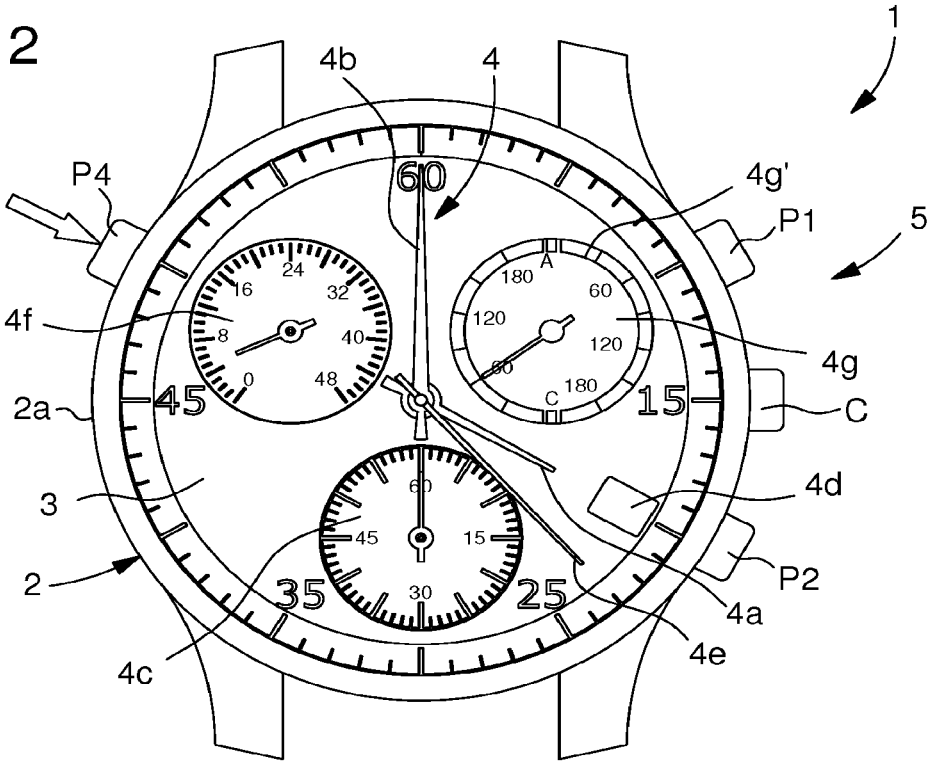

In the case, seen in FIG. 12, where the time and the penalties are separated, the hand of first counter 4*f* is placed at 5, which is the number of penalties and the time displayed by the hand of second counter 4*g* and central hand 4*e* is reduced by 15 seconds, namely the additional time added by said penalties. The hand of second counter 4*g* thus indicates the 60-second position of section 4*g*' relating to Table C, whereas central hand 4*e* indicates position 23.

A press on push-button P4 exits step F and returns said counters to zero so that the time and penalties of another rider can be measured.

In an alternative, control means 5 take a form other than push-buttons.

Firstly, the control means may comprise touch means in addition to crown C. These touch means may be located on crystal 2*b* and/or on case 2. When the touch means are arranged on case 2, they may be located on the case middle 2*a* or on bezel 2*d*.

Secondly, control means 5 may use bezel 2*d* as a rotating bezel for selection. In an embodiment example, bezel 2*d* comprises a cam cooperating with push-button type control means placed inside case middle 2*a*. When the bezel is made to rotate, the cam transforms this rotational motion into a translational motion applied to the control members. For example, a clockwise rotation allows a first control member to be acted on, whereas an anti-clockwise rotation allows a second control member to be acted on. Bezel 2*d* also comprises resilient means attached to said bezel and to case middle 2*a* to achieve an elastic return when the user releases said bezel 2*d*.

In a variant of step E called E', it is possible to incorporate a rule specific to show jumping. Indeed, electronic module 6 is able to manage any interruption that may occur and which requires the time measurement to be stopped to avoid penalising the rider. Two types of interruption are envisaged: a first type of interruption is external and may consist of an unauthorised entry onto the course. A second type of interruption is internal and may be, for example, the refusal of a horse to jump the obstacle. The consequence differs depending on the type of interruption.

Indeed, an external interruption is not considered to be due to the rider and is not sanctioned. Consequently, in the event of such an interruption, a press on push-button P1 stops the time measurement. Another press on push-button P1 causes the time measurement to resume from where it stopped.

Conversely, an internal interruption is considered to be the responsibility of the rider and is sanctioned. Consequently, in the event of such an interruption, a press on push-button P1 stops the time measurement. A long press on push-button P1 allows the time measurement to resume from where it stopped while adding a time penalty. This time penalty is defined as being equal to six seconds.

In a variant, display means 4 comprise a second central hand 4*e*'. This second central hand 4*e*' is used for the display of the hundredths of a second so that when the time measurement is stopped, this hand moves on a scale graduation to indicate the hundredths of measured time.

It will be clear that various alterations and/or improvements evident to those skilled in the art may be made to the various embodiments of the invention described in this description without departing from the scope of the invention.

Thus, it is possible to envisage the watch or portable object 1 also being able to perform a conventional chronograph function. To achieve this, display means 4 comprise at least one central chronograph hand. To enter the chronograph mode, the user presses on push-button P4 for a longer duration than that required to enter the first phase or the second phase. This central chronograph hand is used for 60-second timing, i.e. one revolution of the dial.

Likewise, it will be understood that the timepiece movement may be purely mechanical.

It will also be understood that the portable object according to the present invention is not limited to an equestrian activity and may be used for an activity such as a biathlon or kayaking.

Finally, it will be understood that the portable object according to the invention is capable of simply displaying penalty points.

The invention claimed is:

1. A portable object comprising:

an electronic module driving display means for display of at least one additional function in addition to a normal current time display, the at least one function being controlled by control means and comprising at least one phase using at least one operating mode selected from between a first operating mode and a second operating mode in each of which a duration of the phase is measured and compared to a reference value, the electronic module also allowing at least a manual counting and display of one type of random occurrence occurring during the phase, for the first and second operating modes, the first operating mode is wherein the measured phase duration is compared to a first reference value, the random occurrences comprising a first type of occurrence counted in a form of points automatically when the measured phase duration exceeds the first reference value and a second type of occurrence also counted in a form of points manually by a user by the control means, the second operating mode being wherein the measured phase duration is compared to a second reference value, the random occurrences comprising a third type of occurrence automatically detected when the measured phase duration exceeds the second reference value and a fourth type of occurrence recorded manually, in a form of time automatically added to the measured duration for the phase, by the user by the control means.

2. The portable object according to claim 1, wherein in the first operating mode, the first type of occurrence and the second type of occurrence cause a first counting means to be incremented.

3. The portable object according to claim 1, wherein in the second operating mode, the third type of occurrence causes the phase to stop, the fourth type of occurrence causing a first counting means to be incremented.

4. The portable object according to claim 1, wherein the display means comprises a first counter for display of at least one item of information relating to management and recording of random occurrences and a central hand associated with a second counter for at least display of measurement of the phase duration.

5. A function control method for a portable object, the portable object including an electronic module driving display means for display of at least one additional function in addition to a normal current time display, the at least one function being controlled by control means of the portable object and including at least one phase using at least one operating mode selected from between a first operating mode and a second operating mode in each of which duration of the phase is measured and compared to a reference value, wherein the additional function can change from a rest phase, in which time is not measured, to an operating phase, in which time is measured, the operating phase comprising:

a) counting down until the control means is activated by a user or until the countdown has finished;

b) measuring time and managing and taking account of random occurrences occurring during the phase for the operating mode;

c) displaying the results of b);

wherein, in b) according to the first operating mode, the measured phase duration is compared to a first reference value and the random occurrences include a first type of occurrence counted in a form of points automatically when the measured phase duration exceeds the first reference value and a second type of occurrence also counted in a form of points manually by the user by the control means, and wherein, in b) according to the second operating mode, the measured phase duration is compared to a second reference value and the random occurrences comprise a third type of occurrence, automatically recorded when the measured phase duration exceeds the second reference value, and a fourth type of occurrence manually recorded, in a form of time automatically added to the measured duration for the phase, by the user by the control means.

6. The method according to claim 5, wherein the additional function phase comprises at least a first operating mode and a second operating mode, the first and the second operating mode being selected.

7. The method according to claim 6, wherein selection of the first or the second operating mode for the operating phase is made in a setting phase.

8. The method according to claim 7, wherein the setting phase includes:

d) selecting, via the control means, the first operating mode or the second operating mode and then validating the selection;

e) setting an item of time information according to the first operating mode or the second operating mode;

f) setting an item of random occurrence information according to the first operating mode or the second operating mode.

9. The method according to claim 8, wherein, for the first operating mode, the time information set during e) is the first reference value, and the random occurrence information set during f) relates to the second type of occurrence.

10. The method according to claim 8, wherein, for the second operating mode, the time information set during e) is the second reference value, and the random occurrence information set during f) relates to the fourth type of occurrence.

11. The method according to claim 7, wherein the setting phase is automatic, the electronic module comprising a communication circuit for directly receiving the setting information.

12. The method according to claim 5, wherein the additional function relates to equestrian show jumping.

13. The method according to claim 12, wherein the first type of occurrence, automatically recorded when the measured phase duration exceeds the first reference value, is a settable duration and entails incrementing a penalty counter.

14. The method according to claim 12, wherein the second type of occurrence, recorded manually, is a rider fault and entails incrementing a penalty counter.

15. The method according to claim 12, wherein the third type of occurrence, automatically recorded when the measured phase duration exceeds the second reference value, is elimination of the rider.

16. The method according to claim 12, wherein the second type of occurrence, recorded manually, is a rider fault and entails incrementing the measured duration.

* * * * *